US005822895A

United States Patent [19]

Risdal

[11] Patent Number: 5,822,895

[45] Date of Patent: Oct. 20, 1998

[54] ARCHIVAL VISUAL MEMORIAL

[76] Inventor: Bruce D. Risdal, 420 Cedar St. No. 31, Story City, Iowa 50248

[21] Appl. No.: 558,177

[22] Filed: Nov. 15, 1995

[51] Int. Cl.[6] ..... G09F 19/00

[52] U.S. Cl. ..... 40/124.5; 40/718; 40/734

[58] Field of Search ..... 40/124.5, 718, 40/734

[56] References Cited

U.S. PATENT DOCUMENTS

| | | | |
|---|---|---|---|
| 559,702 | 5/1896 | Gray | 40/124.5 |
| 669,412 | 3/1901 | Harriman | 40/718 X |
| 1,737,474 | 11/1929 | Newhouse | 40/124.5 |
| 3,673,722 | 7/1972 | Robertson | 40/718 |
| 4,183,160 | 1/1980 | Brodersen | 40/718 |
| 4,761,903 | 8/1988 | Cantrell | 40/718 |
| 4,790,088 | 12/1988 | Morvant | 40/124.5 |
| 4,848,014 | 7/1989 | Yesbick | 40/124.5 |
| 5,012,601 | 5/1991 | Garland et al. | 40/718 X |
| 5,205,059 | 4/1993 | Doll | 40/718 |
| 5,230,172 | 7/1993 | Hsu | 40/734 X |
| 5,353,536 | 10/1994 | Erber et al. | 40/718 X |

*Primary Examiner*—Kenneth J. Dorner
*Assistant Examiner*—Andrea Chop
*Attorney, Agent, or Firm*—G. Brian Pingel

[57] ABSTRACT

A visual memorial system for a long term display of an archival print. A pigment-based print generated from a photograph is matted and placed within a resilient frame which is covered with tempered glass opaque to ultraviolet light. The frame is placed within a stainless steel casing which is attached to a gravestone by anchor bolts. The frame is preferably provided on its interior with a desiccant to remove any remaining moisture from the interior of the frame. The archival nature of the pigment-based print along with the sealing techniques used in the frame, produce a resulting memorial system capable of maintaining its clarity for over a century.

17 Claims, 4 Drawing Sheets

ARCHIVAL VISUAL MEMORIAL

BACKGROUND OF THE INVENTION

1. Field of the Invention

The present invention relates in general to a system for displaying a visual representation, and, more specifically, to such a system having an archival print in a hermetically sealed casing capable of preserving the representation for over a century.

2. Description of the Prior Art

Visual representations attached to graveside markers are well-known in the art. U.S. Pat. No. 559,702 shows a photographic case which may be mounted directly to a stone monument. The case uses a piece of glass provided over a picture which is releasably secured to a stone backing. The reference does not discuss the use of an archival print, nor any means for protecting the print from damage due to light, moisture, or oxidation. Accordingly, the longevity of the picture would be necessarily limited.

U.S. Pat. No. 1,737,474 issued to Newhouse, refers to the provision of a chamber in a gravestone. A picture or portrait is placed within the chamber which is then sealed with double wall glass, using cork or asbestos to exclude dampness from the chamber. While the '474 patent does teach the desirability of preventing moisture from contacting the picture, the gravemarker must be specifically carved to accommodate the inventive chamber. Additionally, no means are provided for evacuating moisture or air from the chamber to wholly eliminate moisture damage to the picture. Accordingly, despite the large cost associated with forming an accommodative gravestone, the device is not capable of archival protection of a photographic representation. Within a relatively short period of time, the oxygen and moisture within the chamber, combined with ultraviolet light entering the chamber would act to degradize the picture relatively quickly.

U.S. Pat. No. 4,790,088 issued to Morvant discloses a photograph laminated with a light stable abrasion resistant film and secured in a molded picture frame. The device is also provided with means for affixing the device permanently to a gravemarker. While the Morvant device teaches the use of a light stable laminant to protect the photograph from light and moisture and further teaches the use of a hinged metal closure to protect against additional ultraviolet degradation, the use of a standard photographic representation limits the longevity of the device to a relatively short time period. Additionally, the laminant provides only modest protection from ultraviolet light and moisture as demonstrated by the optional provision of a hinged door to protect the device from further attack by the elements. Additionally, the device provides no means for protecting the photograph from oxidation. Additionally, the adhesives used to affix the laminant to the photograph may act to prematurely age the photograph.

U.S. Pat. No. 4,848,014 issued to Yesbick. The Yesbick device teaches the enclosure within a plastic frame of a photograph. Although the Yesbick device may provide some protection from rain, moisture and dirt, no means are provided for protecting the picture from ultraviolet radiation, oxidation, or the early degradation associated with typical photographs. Additionally, because the photograph is in direct contact with the outer frame, the Yesbick device provides little protection against defacement and/or vandalism.

Although the above-described devices are adapted to prolong the longevity of photographic representations associated with gravestones, none of them are known to be currently in widespread usage. The present invention is designed to provide an efficient and long lasting photographic preservation system that can be used in connection with almost any building or gravemarker.

SUMMARY OF THE INVENTION

The present invention provides a visual memorial system for long-term display of an archival print. The system includes a frame having an interior and an exterior. A transparent window is secured to the frame and a pigment-based print depicting a representation substantially similar to a photosensitive visual representation is provided in the interior of the frame. Means are also provided for preventing transfer of oxygen from the exterior of the frame to the interior of the frame.

Preferably the frame is constructed of polysulfide and is secured to the transparent window by polyisobutylene. The interior of the frame is preferably evacuated of substantially all fluid and a desiccant is provided on the interior of the frame to remove any remaining moisture. The window is preferably ultraviolet light blocking glass and is of a thickness sufficient to reduce damage from vandalism.

The frame is preferably provided with windows on either side to display alternative sets of prints. Also, the frame is preferably provided within a stainless steel casing which is used to mount the frame to a gravestone or a building.

DETAILED DESCRIPTION OF THE PREFERRED EMBODIMENT

Figure 1:
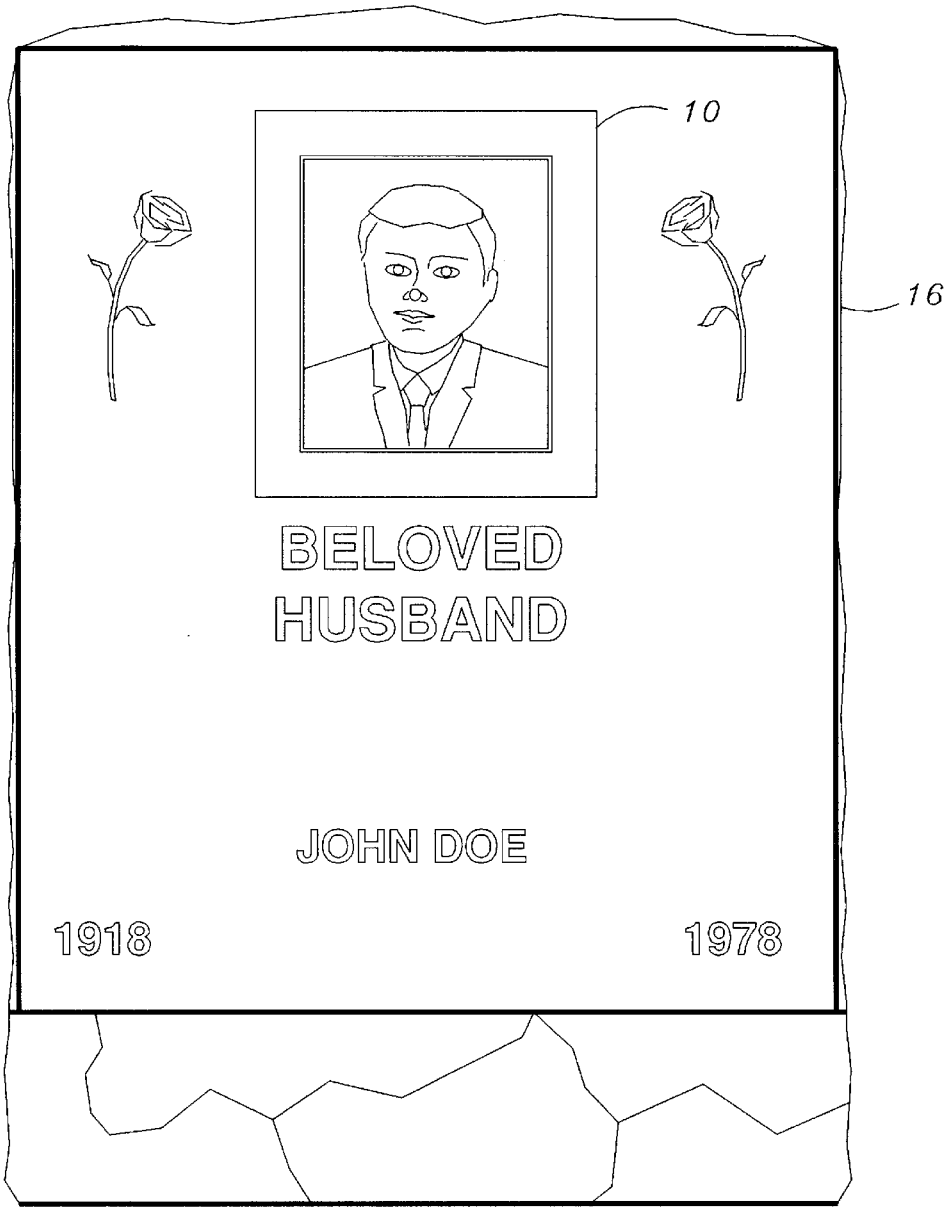
FIG. 1 is a front elevation of the display case of the present invention shown affixed to a gravestone.
Figure 2:
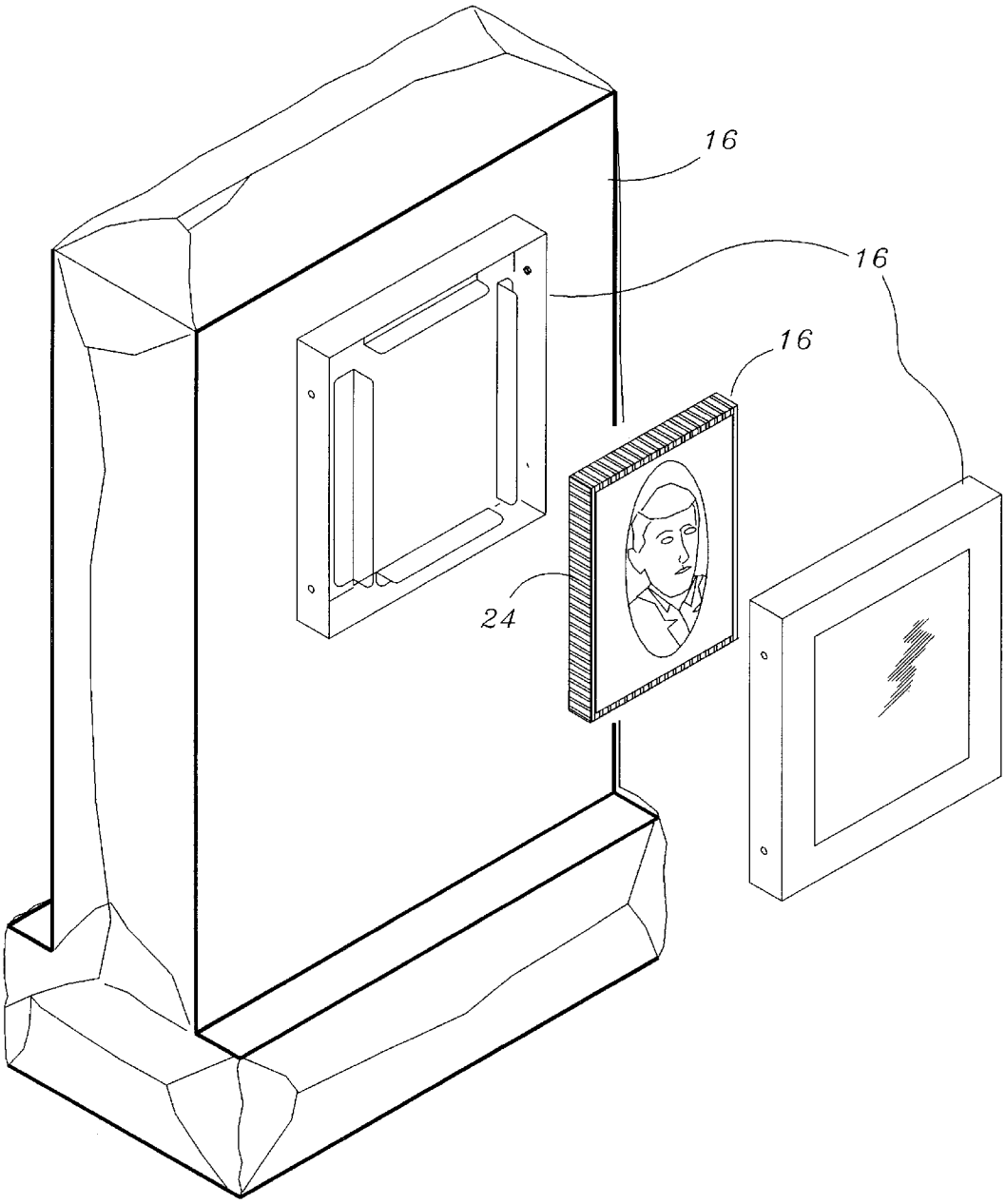
FIG. 2 is a partially exploded view of the display case and gravestone of FIG. 1.
Figure 3A:
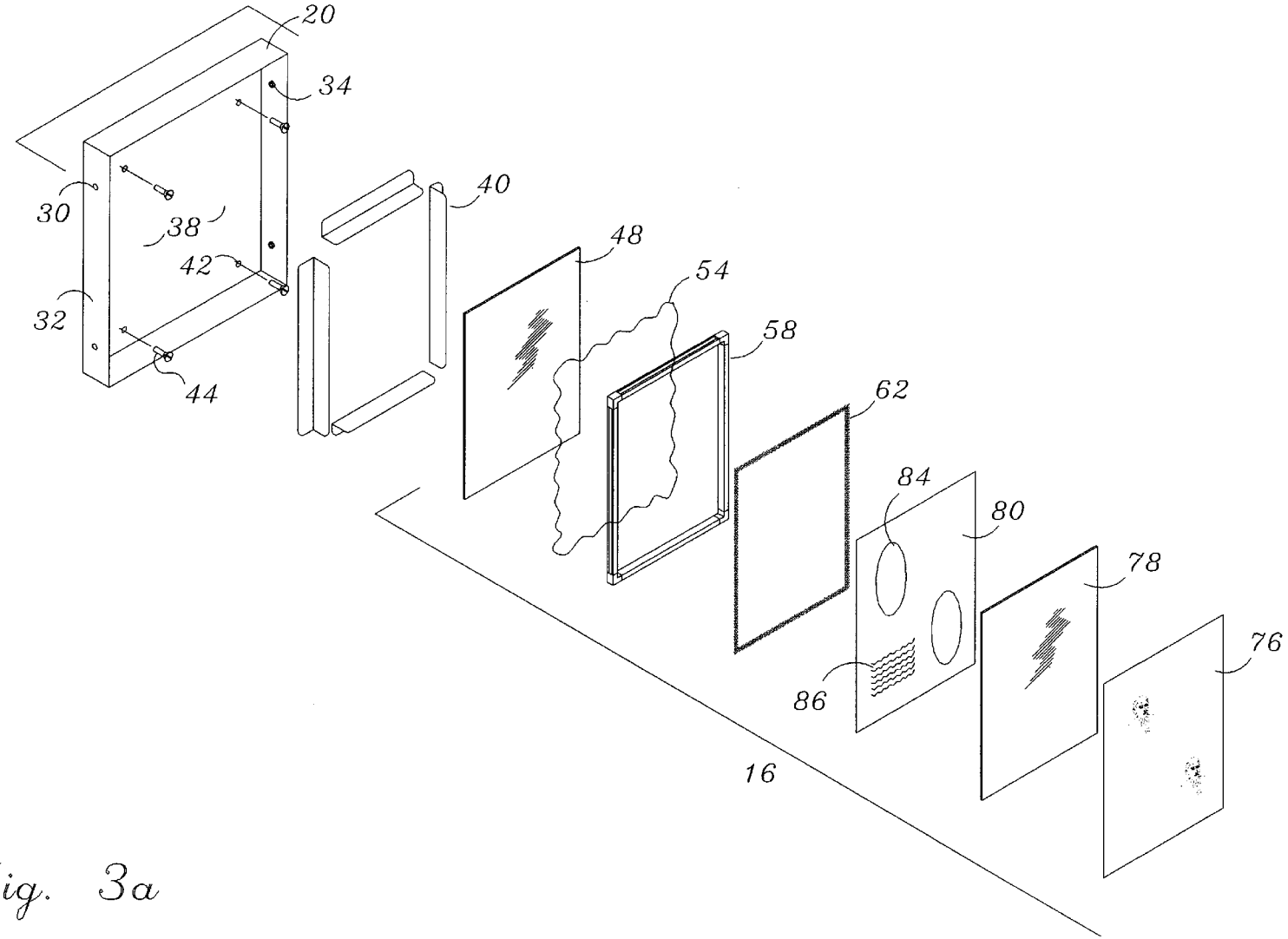
FIG. 3*a* is an exploded perspective view of a portion of the display case of FIG. 1.
Figure 3B:
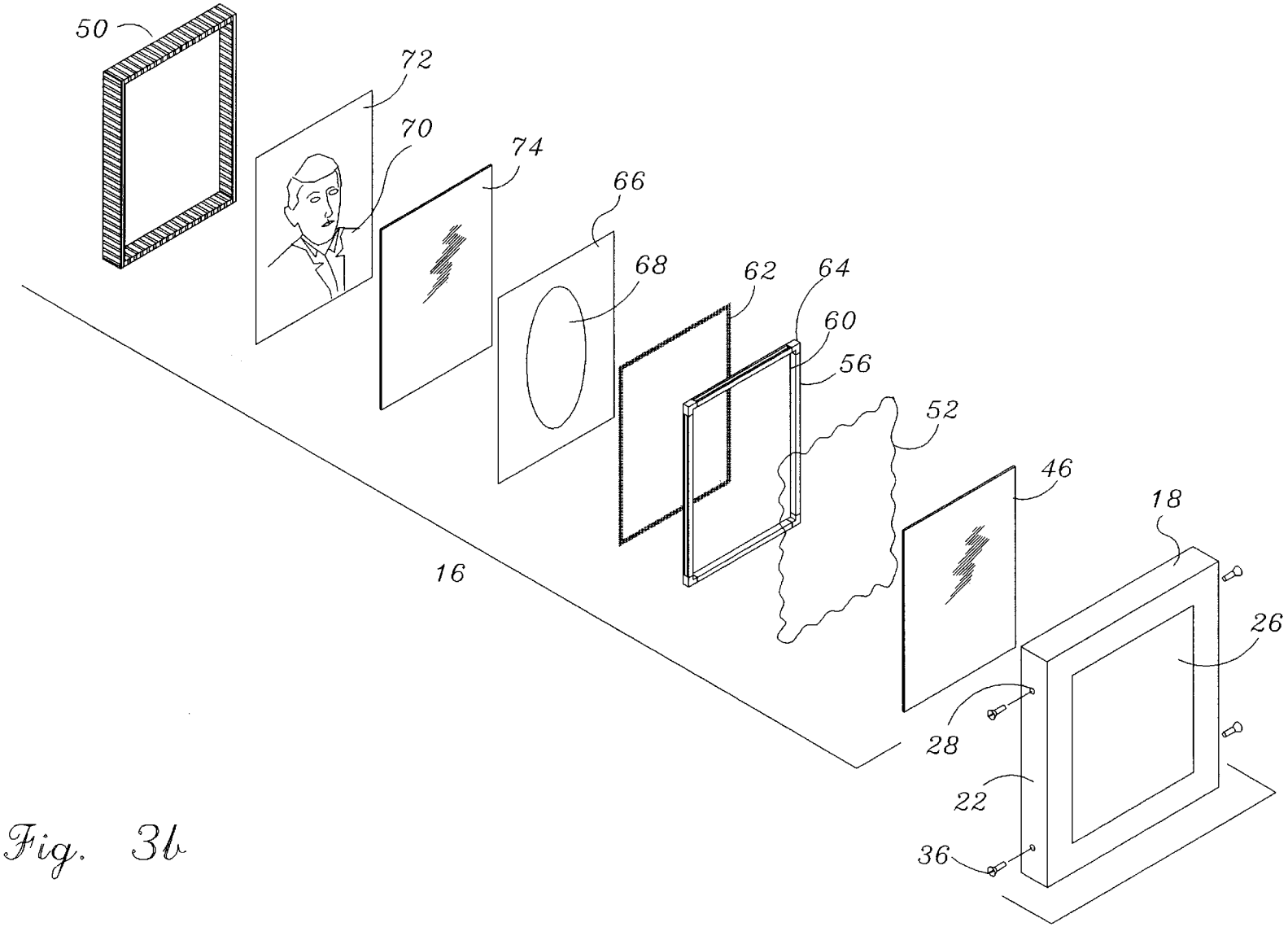
FIG. 3*b* is an exploded view of the remainder of the display case of FIG. 1 which is not shown in FIG. 3*a*.

There is shown in the figures a photographic display case 10 having an inner case 12 and an outer case 14. As shown in FIG. 1, the display case 8 may be affixed to a grave monument 16 for a long term display. As shown in FIGS. 3*a–b*, the inner case 12 is constructed with a plurality of layers. The outer case 14 comprises a stainless steel frame 18 and a stainless steel backing 20. While the frame 18 and backing 20 may be constructed of any suitable material, stainless steel is particularly suitable to the present invention given its resistance to rust and corrosion.

While the stainless steel frame 18 may be of any suitable size, it is desirable to provide the frame 18 with sidewalls 22 of a width and combined length greater than sidewalls 24 provided on the inner case 12. The frame 18 is also provided with an opening 26 having an area less than the surface area of the inner case 12. The sidewalls 22 of the frame 18 are provided with bolt holes 28 which fit into mating alignment with bolt holes 30 provided on sidewalls 32 of the backing 20. Welded over the bolt holes 30 on the interior of the sidewalls 32 are a plurality of nuts 34 having threads of a size sufficient to accommodate a plurality of bolts 36. The bolts 36 have a length sufficient to pass through the bolt holes 28 of the frame 18 and the bolt holes 30 of the backing 20 to engage the nuts 34 and secure the frame 18 to the backing 20.

The backing 20 is provided with a rear face 38 to which are welded a plurality of buttresses 40. The buttresses 40 are preferably slats of stainless steel arranged to secure the inner case 12 within the backing 20. The rear face 38 of the backing 20 is also provided with a plurality of mounting holes 42 of a size sufficient to accommodate stainless steel anchor bolts 44 used to secure the backing 20 to the grave monument 16.

As shown in FIGS. 3*a–b*, the inner case 12 is provided with a piece of front glass 46 and a piece of rear glass 48 connected by a resilient gasket 50. Preferably the front glass 46 and rear glass 48 are of a low E tempered type designed to resist shock and ultraviolet light penetration. In a preferred embodiment of the present invention the front glass 46 and rear glass 48 are one-eighth of one inch thick. The resilient gasket 50 is preferably constructed of polysulfide to securely seal the inner case 12. A first thin coating of a sealing adhesive 52 is provided between the front glass 46 and the resilient gasket 50 to create an airtight and moisture tight seal therebetween. Similarly, a second thin coating of a sealing adhesive 54 is provided between the rear glass 48 and the resilient gasket 50 to completely seal the inner case 12. While in the preferred embodiment of the present invention, the resilient gasket 50 is constructed of polysulfide, it should be noted that the gasket 50 may be constructed of any suitable sealable material.

Provided behind the front glass 46 are a first set of perforated tubes 56 connected to one another in the form of a square. A second set of perforated tubes 58 are provided within the gasket 50 toward the rear glass 48. The perforated tubes 56 and 58 are constructed of hollow aluminum having very small apertures 60 on at least one face. The tubes 56 and 58 are filled with a desiccant 62 such as potassium chloride or any suitable desiccant well-known in the art. The apertures 60 are preferably of a size large enough to allow moisture to pass into the tubes 56 and 58 while preventing the desiccant 62 from exiting the tubes 56 and 58 through the apertures 60.

Once the tubes 56 and 58 have been filled with desiccant 62, the first set of perforated tubes 56 are connected to one another and the second set of perforated tubes 58 are connected to one another by plastic brackets 64 or similar securement means. Also provided within the resilient gasket 50 is a photographic framing mat 66 which may be of any construction well-known in the art. Preferably, the mat 66 is provided with an aperture 68 of a sufficient size to allow a FIG. 70 depicted on a pigment-based print 72 to show through the mat 66 when the inner case 12 is constructed.

Provided between the pigment-based print 72 and the mat 66 is a standard piece of framing glass 74. To increase the longevity of the FIG. 70, the print 72 preferably has a pigment base rather than a photosensitive emulsion base. To obtain a pigment-based print 72 of a photograph (not shown) or similar photosensitive emulsion-based representation, the photograph may be scanned into a computer (not shown) and printed using pigment base techniques well-known in the art. A particularly suitable process is that provided by EverColor Corporation of 5145 Golden Foothill Parkway, No. 140, El Dorado Hills, Calif. 95762 such as that described at page 115 et seq. of Shutterbug magazine which is hereby incorporated by reference.

As shown in FIG. 3*a*, a second print 76, framing glass 78 and mat 80 are provided within the resilient gasket 50. The second print 76, however, is placed back-to-back with the print 72 so that FIGS. 82 may be viewed through the rear glass 48 and apertures 84 provided in the second mat 80. Either mat 66 or 80 may be provided with text 86, or text may be applied to the prints 72 or 76 and additional apertures provided in the mats 66 and 80 to accommodate the text.

After the inner case 12 has been assembled, but before the coatings 52 and 54 are applied to seal the inner case 12, a vacuum (not shown) is applied to the inner case 12 pursuant to methods well-known in the art. The vacuum is applied to remove substantially all moisture and air from the interior of the inner case 12 before the coatings 52 and 54 seal off the inner case 12 from ambient moisture and air. Once the inner case 12 has been assembled and sealed, it is ready for placement within the backing 20.

To mount the display case 10 to the grave monument 16 or similar structure, the backing 20 is placed on the grave monument 16 and the anchor bolts 44 are positioned through the mounting holes 42 to attach the backing 20 to the grave monument 16. For large anchor bolts 44 it may be desirable to drill pilot holes (not shown) in the gravestone before the anchor bolts 44 are inserted.

After the backing 20 has been mounted on the grave monument 16, the inner case 12 is placed within the backing 20 secured by the buttresses 40 provided within the backing 20. Once the inner case 12 is secured within the backing 20, the frame 18 is placed over the backing 20 and the bolts 36 are passed through the bolt holes 28 and 30 and secured to the nuts 34. Preferably, the bolts 36 are of a tamper proof type well-known in the art to prevent undesired removable of the bolts 36 from the display case 10.

When it is desired to display the second set of FIGS. 82, the bolts 36 are removed and the frame 18 is lifted off of the backing 20. The inner case 12 may thereafter be rotated one hundred and eighty degrees and repositioned within the backing 20 as described above. The frame 18 is thereafter placed over the backing 20 and the bolts 36 are used to secure the frame 18 to the backing 20.

Although the invention has been described with respect to a preferred embodiment thereof, it has to be understood that it is not to be so limited, since changes and modifications can be made therein which are within the full intended scope of this invention as defined by the appended claims. For example, it is anticipated that the gasket 50 may be provided with an opaque backing and the secondary print assembly eliminated if there is no desire to rotate the inner case 12 between a first FIG. 70 and a second FIG. 82. Additionally, it is anticipated that the display case 10 may be affixed to a building (not shown), a sculpture (not shown), or any other similar structure.

What is claimed is:

1. A visual memorial system for long term display of an archival print comprising:

(a) a frame having an interior and an exterior;

(b) a visually transparent window secured to said frame;

(c) a pigment-based print depicting a representation substantially similar to a photo sensitive visual representation, said print being provided in said interior of said frame;

(d) a substantially non-oxidizing environment provided in said interior of said frame;

(e) a tube having an interior and an exterior, said tube being provided with a plurality of perforations communicating said interior of said tube to said exterior of said tube;

(f) wherein said print is provided with a perimeter;

(g) wherein said tube is substantially provided around said perimeter of said print;

(h) a desiccant provided within said tube wherein said desiccant is larger than said perforations; and (i) means for preventing transfer of oxygen from said exterior of said frame to said interior of said frame.

2. The system of claim 1, wherein in said visually transparent window is constructed of low-e glass.

3. The system of claim 2, wherein said print is of a construction which retains at least ninety percent of its clarity after 100 years of exposure to natural lighting.

4. The system of claim 2, further comprising means for attaching said frame to a structure.

5. The system of claim 4, wherein said structure is a gravestone.

6. The system of claim 4, further comprising means for preventing unauthorized non-destructive removal of said frame from said structure.

7. The system of claim 2, wherein said visually transparent window is of a construction which prevents at least about ninety percent of ultraviolet light contacting said visually transparent window from passing through said visually transparent window.

8. The system of claim 2, wherein said preventing means is a polyisobutylene sealed between said frame and said transparent window.

9. The system of claim 2, wherein said frame is a resilient gasket.

10. The system of claim 2, wherein said frame is a polysulfide gasket.

11. The system of claim 2, further comprising a substantially rust-proof casing provided around said frame.

12. The system of claim 2, further comprising a supplemental transparent window secured to said frame and positioned over a supplemental pigment-based print depicting a representation substantially similar to a photosensitive visual representation.

13. The system of claim 1, wherein said substantially non-oxidizing environment is a vacuum.

14. A visual memorial system for a long term display of an archival print comprising:

(a) a casing having an interior and an exterior;

(b) a frame having an interior and an exterior, said frame positioned within said interior of said casing;

(c) a visually transparent low-e window secured to said frame by a seal sufficient to substantially prevent transfer of oxygen from said exterior of said frame to said interior of said frame;

(d) a pigment-based print positioned within said interior of said frame;

(e) a tube having an interior and an exterior, said tube being provided with a plurality of perforations communicating said interior of said tube to said exterior of said tube;

(f) wherein said print is provided with a perimeter;

(g) wherein said tube is substantially provided around said perimeter of said print;

(h) a desiccant provided within said tube wherein said desiccant is larger than said perforations; and (i) means for securing said casing to a structure.

15. The system of claim 14, wherein said structure is a grave stone.

16. The system of claim 15, further comprising means for preventing unauthorized non-destructive removal of said casing from said grave stone.

17. The system of claim 14, wherein said visually transparent window is of a construction which prevents at least about ninety percent of ultraviolet light contacting said visually transparent window from passing through said transparent window.

* * * * *